US007246401B2

(12) United States Patent
Condliff

(10) Patent No.: US 7,246,401 B2
(45) Date of Patent: Jul. 24, 2007

(54) HOLE CLEANING APPARATUS

(75) Inventor: Christopher D. Condliff, Issaquah, WA (US)

(73) Assignee: The Boeing Company, Chicago, IL (US)

( * ) Notice: Subject to any disclaimer, the term of this patent is extended or adjusted under 35 U.S.C. 154(b) by 657 days.

(21) Appl. No.: 10/638,362

(22) Filed: Aug. 12, 2003

(65) Prior Publication Data

US 2005/0034259 A1 Feb. 17, 2005

(51) Int. Cl.
*B08B 1/00* (2006.01)

(52) U.S. Cl. ..... 15/210.1; 15/104.05; 15/97.1; 15/101

(58) Field of Classification Search ..... 15/210.1, 15/104.05, 104.03, 97.1, 101, 211
See application file for complete search history.

(56) References Cited

U.S. PATENT DOCUMENTS

| | | | | |
|---|---|---|---|---|
| 2,301,853 | A * | 11/1942 | Cannon | 451/355 |
| 2,851,008 | A * | 9/1958 | Rochester | 15/210.1 |
| 3,889,310 | A * | 6/1975 | Barouh et al. | 15/210.1 |
| 5,117,528 | A * | 6/1992 | Kanayama et al. | 15/210.1 |
| 5,878,458 | A * | 3/1999 | Higginbotham | 15/104.94 |
| 6,209,163 | B1 * | 4/2001 | Clairadin et al. | 15/97.1 |
| 6,695,917 | B2 * | 2/2004 | Wright et al. | 118/257 |
| 6,905,251 | B2 * | 6/2005 | Fujiwara et al. | 385/53 |

* cited by examiner

*Primary Examiner*—Gary K. Graham
(74) *Attorney, Agent, or Firm*—Baker Hostetler LLP

(57) ABSTRACT

An apparatus for cleaning a hole or bore in a work piece has a reel, a switch, a mandrel, a cutting edge and a cleaning material. The cleaning material is driven by the first reel and extends over the mandrel. The trigger causes the first reel to pull the cleaning material over the mandrel to clean the hole or bore.

17 Claims, 4 Drawing Sheets

HOLE CLEANING APPARATUS

FIELD OF THE INVENTION

The present disclosure relates generally to a cleaning apparatus and method. More particularly, the present disclosure relates to an apparatus and method for cleaning openings or holes, such as for example, fastener holes.

BACKGROUND OF THE INVENTION

The skin of an aircraft is typically composed of multiple, individual pieces that must be securely attached to both one another and/or to a support structure. During the manufacture and assembly process, the aforementioned individual skin pieces are drilled with holes so that they may be via fasteners and/or rivets. It is oftentimes required to prepare the holes of these components prior to attachment. This preparation of the holes typically requires that the holes be cleaned prior to rivet insertion, because they may contain residual dirt and contaminants, such as lubricant and/or solvent.

Preparation techniques currently used in the art include inserting or pushing a swab of gauze through an open fastener hole using a tool or poking device such as a screw driver. Other techniques currently utilized in the art entail inserting a cotton tipped stick or swab through an open fastener hole. Prior to insertion into the holes, the gauze or cotton tipped stick of the aforementioned techniques are oftentimes soaked or saturated in Methyl Propyl Ketone (MPK) or other cleaning solvents to aid in the removal of contaminants and dirt from the holes.

The above-described hole preparation techniques have drawbacks however. For example, hole preparation, specifically the cleaning of the hole prior to fastener installation, accounts for a significant amount of time, manpower and resources during the aircraft assembly process. Furthermore, the aforementioned hole preparation techniques can be somewhat tedious and fatiguing to the mechanic operator performing the task. In addition, waste is generated as a result of the techniques currently employed to prepare holes which must be disposed of properly, adding additional cost to the assembly process. Therefore, given the number of holes on a standard commercial aircraft, and given the fact that typically, each and every hole must be manually prepared, it would be desirable if hole preparation techniques were made more efficient in terms of time consumption and cost.

The hole preparation process is typically a multi-step process. During the process the mechanic or technician may prepare upwards of 1000 holes during his or her shift. This process is oftentimes preceded by a process of saturating the cotton swabs or gauze with cleaning solvents prior to insertion into the hole to aid in the removal of contaminants, which requires additional time. Next, the swab is forced or inserted into the hole. The force required by the mechanic or technician to pass a cotton swab through an individual hole can oftentimes be significant, making the process laborious when repeated many times. Once the swab is passed through the hole, the next step the mechanic or technician performs is to analyze both the hole and swab for dirt and contaminants to determine if an additional treatment is required. Oftentimes a second pass with a new swab is required to ensure the hole is, in fact, clean. As a result, hole preparation sometimes requires a significant amount of time due to the number of holes on an aircraft structure and the multiple steps involved to insure they are prepared properly, requiring the employment of multiple operators or technicians.

Furthermore, as previously mentioned, the current preparation techniques can generate large amounts of waste. Each time a piece of gauze or a cotton swab is passed through a hole, waste is generated. Also, as previously mentioned, a single gauze swab may not be enough to thoroughly clean a hole, necessitating multiple passes through a hole using multiple swabs. Thus, to thoroughly and correctly clean holes prior to rivet or fastener insertion, a large amount of waste material may be generated. In addition, the gauze or cotton is typically treated with solvents, and therefore may require additional disposal steps.

Also, another drawback typically associated with the above-described techniques is that as a swab is pushed through a hole, it exits out the opposite site of the hole where it typically drops onto the factory floor or another section of the aircraft structure. When the swab contacts the aircraft or after exiting the hole, it can transfer contaminants to the other aircraft structure. As a result, the aircraft must be cleaned to remove the contaminants that were possibly transferred and the used swabs that have accumulated as a result of the cleaning must be collected and disposed of, both of which can contribute additional time and manpower to the preparation process.

Accordingly, there is a need in the art to provide a cleaning apparatus and method that allows for convenient and efficient preparation and cleaning of holes prior to rivet or fastener insertion. Also, there is a further need for an apparatus and method for preparing holes prior to fastener insertion that reduces the amount of waste produced during the preparation process.

SUMMARY OF THE INVENTION

The foregoing needs are met, to a great extent, by the embodiments described herein, wherein in one aspect a hole cleaning apparatus and method are provided for use with a cleaning material. The apparatus includes a frame assembly and a mandrel having a first end and a second end, which is mounted to the frame. The mandrel has an inner bore that extends from the first end to the second end. The apparatus also includes a first reel mounted to the frame assembly. The reel can be rotated by a motor to pull the cleaning material over the mandrel.

In accordance with another embodiment, a hole cleaning apparatus is provided having a frame assembly and a handle connected to the frame assembly. The apparatus also includes a first reel mounted to the frame assembly, wherein the first reel is rotated by a motor. The apparatus further includes a switch that extends for the frame assembly that activates the motor. The apparatus additionally includes a mandrel having an inner bore that extends from its first end to its second end. A cutting edge is mounted to the first end of the mandrel. The apparatus also includes a cleaning material that is pulled over the mandrel by the first reel. The cleaning material extends between the first reel and the mandrel.

In accordance with yet another embodiment, a hole cleaning apparatus is provided which includes a handle having a first and second end with a bore extending therethrough. The apparatus also includes a mandrel having a first and second end and an inner bore. The mandrel is connected to the handle. The apparatus further includes a spool holder connected to the second end of the handle along with a cleaning material connected to the spool holder. A cutting edge is also disposed on the mandrel. The cleaning material extends from the spool holder through the bore of the handle and the bore of the mandrel.

In accordance with still another embodiment, an apparatus for cleaning a hole, wherein the apparatus includes a mandrel having an inner portion and an outer portion, a switch and a cleaning material, is provided. The apparatus includes a means for inserting the mandrel into a hole to be cleaned. The apparatus also includes a means for pulling the cleaning material through the inner portion of the mandrel and the outer portion of the mandrel along with a means for activating the pulling means.

In accordance with yet another embodiment, a method for cleaning a hole using a cleaning apparatus having a hollow mandrel having a central bore and an outside surface, and wherein the cleaning apparatus also includes a switch and utilizes a cleaning apparatus employs a cleaning material, comprising: biasing the switch in a first direction; inserting the hollow mandrel into a hole to be cleaned; translating the switch in a second direction opposite to the first direction; and pulling the cleaning material through the central bore of the mandrel and then along the outside surface of the mandrel.

There has thus been outlined, rather broadly, certain embodiments in order that the detailed description thereof herein may be better understood, and in order that the present contribution to the art may be better appreciated. There are, of course, additional embodiments that will be described below and which will form the subject matter of the claims appended hereto.

In this respect, before explaining at least one embodiment in detail, it is to be understood that the various embodiments are not limited in its application to the details of construction and to the arrangements of the components set forth in the following description or illustrated in the drawings. Other embodiments in addition to those described are capable of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the various embodiments. It is important, therefore, that the claims be regarded as including such equivalent constructions insofar as they do not depart from the spirit and scope of the disclosure.

DETAILED DESCRIPTION

Figure 2:
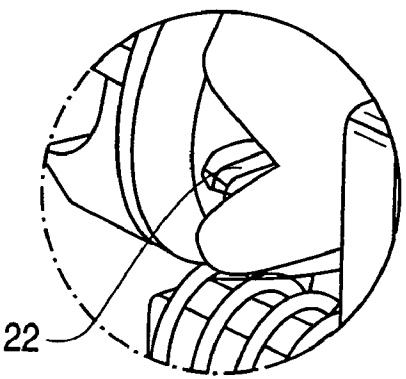
FIG. 2 is a detailed view showing a cutting feature utilized on the embodiment of the cleaning apparatus depicted in FIG. 1.

Various preferred embodiments provide for cleaning holes prior to insertion of a bolt, screw, fastener and/or rivet. In some arrangements, the apparatus and method are utilized for cleaning fastener holes located on components that cover the frame and internal components of a commercial aircraft. It should be understood, however, that the embodiments are not limited in its application to aircraft manufacture, or the aircraft industry, but, for example, can be used with other manufacturing processes and industries that require the preparation or cleaning of holes or bores prior to the insertion of a screw, bolt, fastener, or the like. An embodiment will now be further described with reference to the drawing figures, in which like reference numerals refer to like parts throughout.

Figure 1:
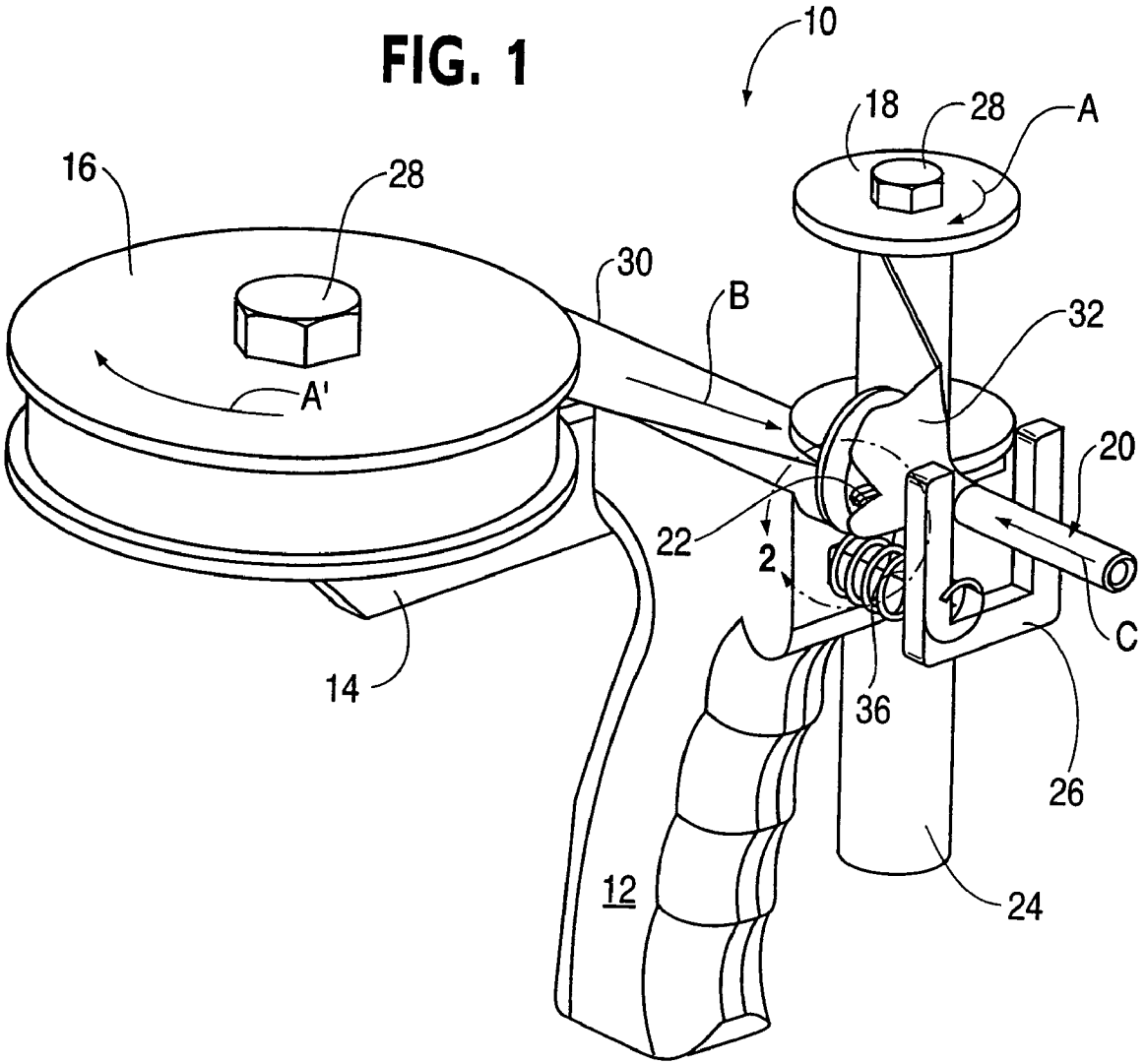
FIG. 1 is a front, perspective view of a hole cleaning apparatus in accordance with an embodiment.
Figure 3:
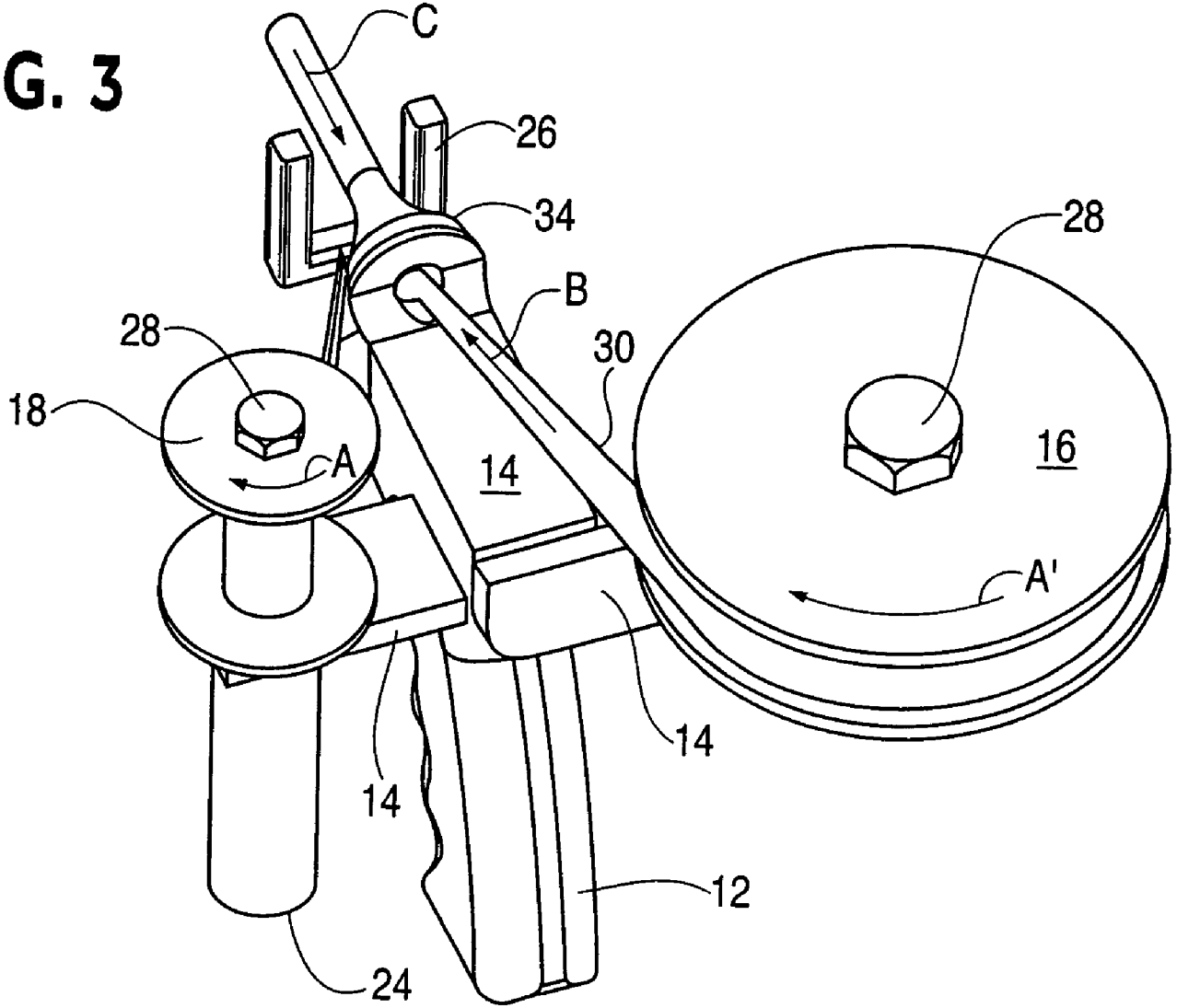
FIG. 3 is a rear, perspective view of the hole cleaning apparatus depicted in FIG. 1.

Referring now to the figures, FIGS. 1–3 illustrate a hole cleaning apparatus, generally designated 10, in accordance with an embodiment. The apparatus 10 includes a handle 12, a frame 14 connected to the handle 12, a pay-out reel 16 connected to the frame 14 and a take-up reel 18 also connected to the frame 14. The apparatus 10 further includes a hollow mandrel 20 that has a blade 22 preferably connected to one side. The mandrel 20 is connected to the frame 14 and extends outward away from the handle 12. The cleaning apparatus 10 also includes a drive motor 24 connected to the frame 14, and an actuating switch or trigger 26.

As depicted in FIGS. 1 and 2, the pay-out reel 16 and the take-up reel 18 are mounted to the frame 14. The reels 16, 18 are mounted to the frame 14 via a mounting means 28, preferably a bolt. Although a bolt 28 is depicted, alternative mounting means known in the art may also be utilized to mount the reels 16, 18 to their respective frame 14 components.

As illustrated in FIGS. 1 and 3, the pay-out reel 16 is preferably positioned at the rear of the handle 12 and dispenses or "pays-out" a cleaning material. Preferably, the cleaning material is tubular, cloth gauze, however any material used in the art for the purposes of cleaning may be employed. The clean, tubular gauze is generally designated 30. By clean gauze, it is understood that the gauze has not contacted the hole to be cleaned. Conversely, the take-up reel 18 is preferably located at a more forward location with respect to the handle 12, and on the opposite side of the handle 12. The take-up reel 18 functions to collect the used or contaminated gauze, generally designated 32, once it passes through the hole and departs from the mandrel 20. As previously described, the apparatus 10 preferably employs gauze in tubular form. The clean gauze 30 is fed from the pay-out reel 16, through the mandrel 20, where it is then wrapped back over the outside of mandrel 20 where it proceeds to the take-up reel 18. Alternatively, the reels 16, 18 may be oriented at different positions with respect to each other and with respect to the handle 12.

As illustrated in FIGS. 1 and 3, the mandrel 20 is hollow having a central bore through which the clean gauze 30 dispensed from the pay-out reel 16 travels. The mandrel 20 includes a flared out or generally cone-shaped base 34 that is connected to the frame 14 of the apparatus 10. The mandrel 20 may be stepped or have various regions or portions having varying diameters. In addition, replacement or additional mandrels 20 may be stored on the apparatus 10. The blade 22 is preferably located at the base 34 of the mandrel 20. The base 34 functions to direct the gauze 32 and reduce the likelihood of it snagging.

Referring now to FIG. 2, the blade 22 is preferably a slitter knife positioned on one side of the base 34 of the mandrel 20. The blade 22 slits the tubular gauze along one side, converting the tubular gauze from a tubular form to a ribbon form, generally designated 32. This enables the gauze 32 to depart for the mandrel 20 and wrap onto the take-up reel 18.

The drive motor 24, as depicted in FIGS. 1 and 3, is connected to the take-up reel 18 and functions to rotate the reel 18 in the clockwise direction as indicated by the arrow A pulling the gauze through the apparatus 10. In the embodiment depicted, the drive motor 24 is a pneumatic motor that is connected to a pressurized air source. Although a pneumatic drive motor is depicted, alternative motors may be employed for example, battery powered or electric powered motors.

The drive motor 24 is activated and controlled by the trigger 26. As depicted in FIGS. 1 and 3, the trigger 26 is an actuating trigger that extends outwardly away from the frame 14. The trigger 26 includes a shaft and is generally U-shaped so that it partially surrounds the mandrel 20. The trigger 26 has a biasing means 36, for example a coil spring, that biases the trigger 26 in the outward direction, away from the handle 12. Alternatively, the trigger may be mounted on the handle 14 and be actuated or activated when depressed by the operator.

In the embodiment depicted, the trigger 26 also functions to assist in keeping the mandrel 20 perpendicular and/or normal with the surface of the component in which the hole is drilled. Perpendicular positioning between the mandrel 20 and the hole to be cleaned is desired to prevent the likelihood of the gauze binding as it is pulled between the outside surface of the mandrel 20 and the surface of the hole.

During operation, the mandrel 20 is inserted into the hole to be cleaned, causing the trigger 26 to come into contact with the surface of the part or component in which the hole is located. This contact causes the trigger 26 to depress or translate in the inward direction towards the handle 12. As the trigger 26 translates, it activates the drive motor 24 which rotates the take-up reel 18 in the clockwise direction as indicated by the arrow A. As the take-up reel 18 rotates, it pulls gauze through the apparatus 10.

Alternatively, the apparatus 10 may be modified to include a component that saturates or treats the gauze with a cleaning agent or solvent prior to the gauze entering the mandrel 20. Moreover, the gauze may be pre-treated with a solvent and/or cleaning agent prior to mounting it on the pay-out reel 16.

Referring now to FIGS. 1–3, the pulling action of the take-up reel 18, causes the pay-out reel 16 to rotate in the clockwise direction, as indicated by arrow A. The tubular gauze is dispensed from the pay-out reel 16 through the inside of the hollow mandrel 20, as indicated by arrow B. As the gauze exits the hollow mandrel 20, it is wrapped back over and pulled along the outside of the mandrel 20 as indicated by arrow C. As the gauze travels along the outside of the mandrel 20, it contacts the surface of the hole, removing dirt, sealant and any residual lubricant that may remain from the drilling process. As the gauze reaches the base 34 of the mandrel 20, it is slit along one side by the blade 22, converting the gauze from a tubular form to a ribbon form 32. The gauze 32, after it is slit, then departs from the mandrel 20 where it is wrapped onto the take-up reel 18.

During operation of the cleaning apparatus 10, as the mandrel 20 is further inserted into the hole to be cleaned, the trigger 26 is further depressed or translated. This additional translation of the trigger 26 causes the drive motor 24 to increase the rotational speed of the take-up reel 18, which cause the gauze to be pulled through the mandrel 20 quicker. As a result of the aforementioned increased speed of the motor 24, the amount of gauze fed through an individual hole increases, thereby reducing the amount of time required to clean the hole. Alternatively, if a hole requires less preparation, the trigger 26 may be only partially depressed, causing a slower rotational speed of the motor and thereby conserving gauze.

While the apparatus 10 is being operated, the technician or operator can monitor the gauze as it exits the hole to determine whether the hole is still contaminated or sufficiently clean. If the gauze continues to show signs of dirt and contaminants as it exits the hole, the operator can continue to keep the trigger 26 depressed and pull more gauze through the hole. Alternatively, when the gauze begins to show no signs of dirt, the technician can remove the mandrel 20 from the hole, which causes the trigger 26 to translate in the opposite outward direction, stopping the drive motor 24.

Figure 4:
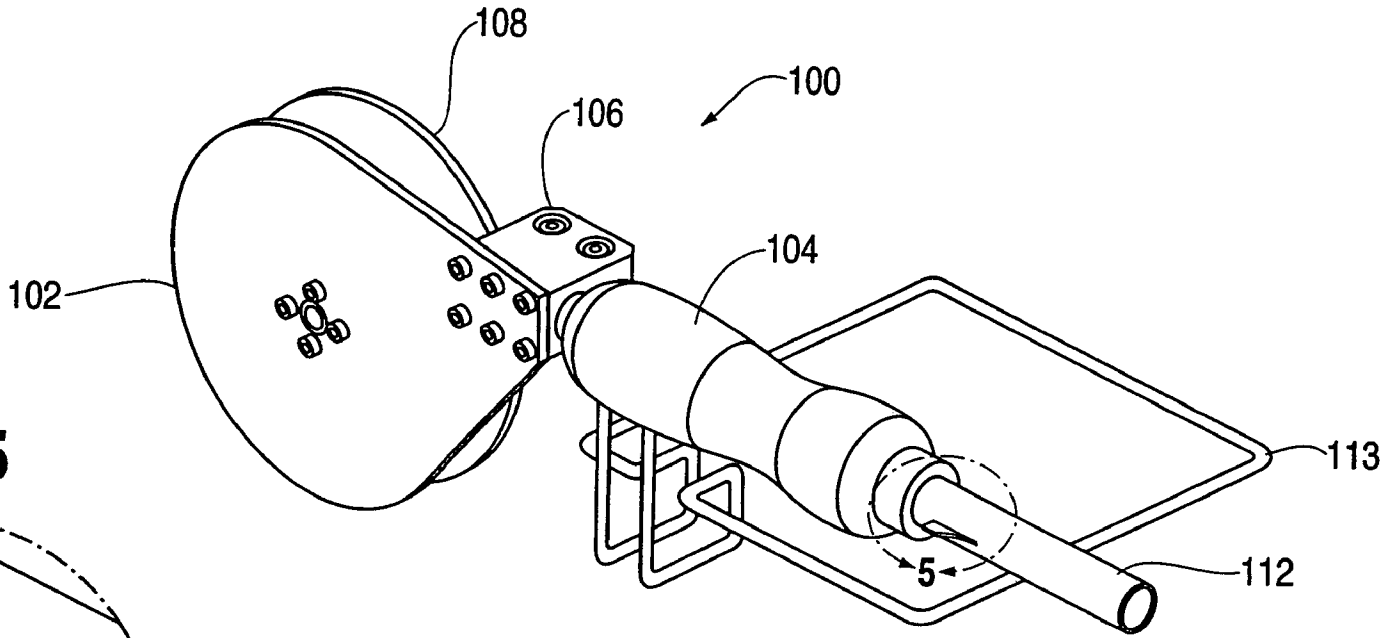
FIG. 4 is a side, perspective view of a hole cleaning apparatus in accordance with another embodiment.
Figure 5:
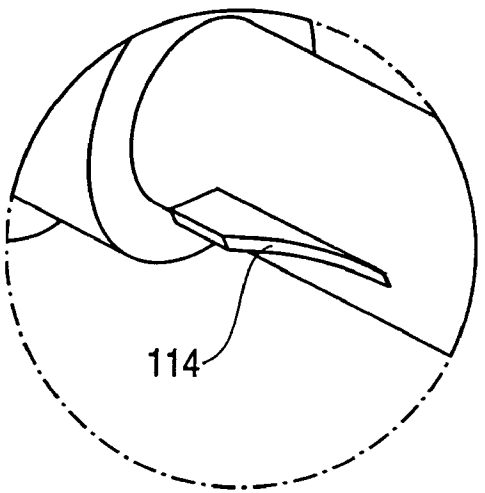
FIG. 5 is a detailed view showing a cutting feature utilized on the embodiment of the cleaning apparatus depicted in FIG. 4.
Figure 6:
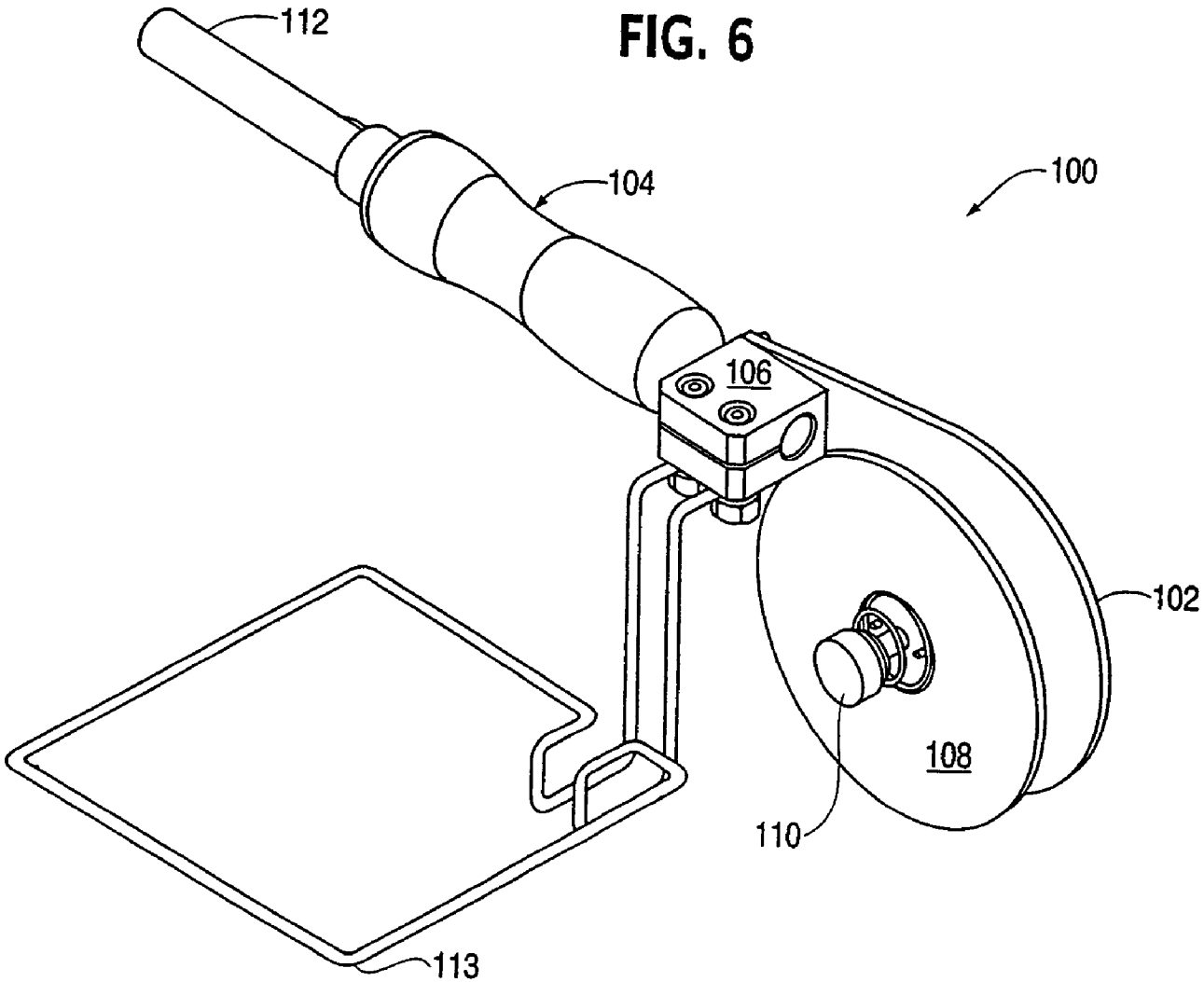
FIG. 6. is an opposite side view of the hole cleaning apparatus depicted in FIG. 4.

Referring now to FIGS. 4–6, a simplified embodiment of the cleaning apparatus depicted in FIGS. 1–3, generally designated 100, is illustrated. The cleaning apparatus 100 includes a gauze spool holder 102 mounted to a handle 104. The handle 104 preferably has a central bore that extends its entire length. The gauze spool holder 102 is mounted to the handle via a bracket 106. The spool holder 102 includes a spool friction clutch plate 108. A spool of gauze is retained on a hub within the spool holder 102 and is captured by the friction clutch plate 108. The amount of pressure exerted by the friction clutch plate 108 on the gauze spool is controlled by a clutch adjustment knob 110.

The cleaning apparatus 100 also includes a hollow mandrel 112 that is connected to the handle 104. As depicted in FIG. 6, the bracket 106 has a bore 116. The bore 116 provides an entrance for tubular gauze to enter the mandrel 112 as it is fed from the spool holder 102. The handle 104, bracket 106 and mandrel 112 are connected in a series as depicted in FIGS. 4 and 6, so that each of their respective central bores is aligned with one another, providing a single, continuous bore that extends from the bracket 106 through the handle 104, and on to the mandrel 112.

The cleaning apparatus 100 additionally includes a support frame 113 also connected to the bracket 106. The support frame 113 functions to support a waste gauze retainer such as a bag. Like the embodiments depicted in FIGS. 1–3, the mandrel 112 has a cutting arrangement, preferably a slitting knife blade 114 disposed on one side. Similar to the embodiments depicted in FIGS. 1–3, the slitting knife 114 is positioned at one side of the mandrel 112 that slits the gauze along one side, converting it from the tubular form to the ribbon form. This allows the gauze to depart from the mandrel 112 and be disposed in a waste bag or container located on the support frame 113.

During operation of the cleaning apparatus 100, tubular gauze is initially fed from the spool holder 102 through the mandrel entrance 116. The tubular gauze then travels through the bracket 106 and the handle 104 via their respective bores to the hollow mandrel 112. Similar to the embodiment described previously, the tubular gauze exits the mandrel 112 and is wrapped back over the mandrel 112 so that the gauze may be grasped by the cleaning apparatus 100 operator. Next, the mandrel 112 is inserted into the hole to be cleaned. The tubular gauze is then manually pulled by the operator, along the outside of the mandrel 112. As the gauze travels along the outside of the mandrel 112, it cleans the hole, removing dirt, sealant and any residual lubricant that may remain from the drilling process. As the tubular gauze reaches the base of the mandrel 112 near the handle

104, it is slit along one side by the slitting knife 114, converting the gauze from the tubular form to a ribbon form. The ribbon gauze can then be fed into a plastic bag or other container or receptacle, which is supported and held in place by the frame 113. When the bag or container is full, it can be removed, sealed, labeled, and disposed of properly.

While the cleaning apparatus 100 is being operated, the clutch adjustment knob 110 may be adjusted, controlling the amount of pressure exerted on the gauze spool by the friction clutch 108. This enables the operator to control how easily and smoothly the gauze feeds through the mandrel 112 and the hole in the work piece. The use of the adjustment knob 110 allows the cleaning apparatus 100 to be adjusted and/or adapted to each operator who may use the cleaning apparatus 100.

The many features and advantages of the embodiments are apparent from the detailed specification, and thus, it is intended by the appended claims to cover all such features and advantages of the invention which fall within the true spirit and scope of the various embodiments. Further, since numerous modifications and variations will readily occur to those skilled in the art, it is not desired to limit the various embodiments to the exact construction and operation illustrated and described, and accordingly, all suitable modifications and equivalents may be resorted to, falling within the scope of the various embodiments.

What is claimed is:

1. A hole cleaning apparatus, comprising:

a frame assembly;

a mandrel having a first end and a second end mounted on said frame, said mandrel having an inner bore that extends from said first end to said second end;

a first reel mounted to said frame assembly, wherein said first reel is rotated by a motor to pull a cleaning material over the mandrel; and a cutting edge mounted to said mandrel at said first end.

2. The hole cleaning apparatus according to claim 1, further comprising a handle connected to said frame assembly.

3. The hole cleaning apparatus according to claim 2, wherein said cleaning material extends from said second reel through said bore of said mandrel and from said bore of said mandrel to said first reel.

4. The hole cleaning apparatus according to claim 1, further comprising a switch that extends from said frame assembly that activates said motor.

5. The hole cleaning apparatus according to claim 4, further comprising a biasing member that extends between said switch and said frame.

6. The hole cleaning apparatus according to claim 5, wherein said biasing member is a spring.

7. The hole cleaning apparatus according to claim 6, wherein said spring is a coil spring.

8. The hole cleaning apparatus according to claim 1, wherein said cleaning material extends through said bore of said mandrel to said first reel.

9. The hole cleaning apparatus according to claim 1, further comprising a second reel mounted to said frame assembly, opposite said first reel.

10. The hole cleaning apparatus according to claim 1, wherein said first end of said mandrel is generally cone-shaped.

11. The hole cleaning apparatus according to claim 1, wherein said switch at least partially surrounds said mandrel.

12. The hole cleaning apparatus according to claim 1, wherein said cutting edge comprises a slitting knife.

13. The hole cleaning apparatus according to claim 1, wherein said cleaning material is tubular gauze.

14. The hole cleaning apparatus according to claim 1, wherein said cleaning material is treated with a solvent.

15. A hole cleaning apparatus, comprising:

a frame assembly;

a handle connected to said frame assembly;

a first reel mounted to said frame assembly, wherein said first reel is rotated by a motor;

a switch that extends from said frame assembly that activates said motor;

a mandrel having a first end and a second end mounted on said frame, said mandrel having an inner bore that extends from said first end to said second end;

a cutting edge mounted to said mandrel at said first end; and a cleaning material pulled over said mandrel by said first reel wherein said cleaning material extends between said first reel and said mandrel.

16. An apparatus for cleaning a hole wherein the apparatus includes a mandrel having an inner portion and an outer portion, a switch and a cleaning material, comprising:

means for inserting the mandrel into a hole to be cleaned;

means for pulling the cleaning material through the inner portion of the mandrel and over the outer portion of the mandrel;

means for cutting the cleaning material being pulled over the outer portion of the mandrel; and means for activating said pulling means.

17. The apparatus according to claim 16, wherein said means for pulling is a motor.

* * * * *